United States Patent [19]

Ames et al.

[11] Patent Number: 4,904,314

[45] Date of Patent: Feb. 27, 1990

[54] METHOD OF REFINING MAGNETIC DOMAINS OF BARRIER-COATED ELECTRICAL STEELS USING METALLIC CONTAMINANTS

[75] Inventors: S. Leslie Ames, Sarver; Jeffrey M. Breznak, Springdale, both of Pa.

[73] Assignee: Allegheny Ludlum Corporation, Pittsburgh, Pa.

[21] Appl. No.: 206,051

[22] Filed: Jun. 10, 1988

[51] Int. Cl.[4] ..... H01F 1/04

[52] U.S. Cl. ..... 148/113; 148/111

[58] Field of Search ..... 148/111, 112, 113, 122

[56] References Cited

U.S. PATENT DOCUMENTS 3,990,923 11/1976 Takashina et al. ..... 148/111
4,203,784 5/1980 Kuroki et al. ..... 148/111

FOREIGN PATENT DOCUMENTS 60-255926 12/1985 Japan ..... 148/113
61-133321 6/1986 Japan .
61-139679 6/1986 Japan .
61-284529 12/1986 Japan .
62-51202 3/1987 Japan .
2167324A 5/1988 United Kingdom .

*Primary Examiner*—John P. Sheehan
*Attorney, Agent, or Firm*—Patrick J. Viccaro

[57] ABSTRACT

A method is provided for domain refinement of final texture annealed grain-oriented silicon steels by applying to the base coating a barrier coating for sealing the forsterite, removing portions of the base coating to expose a pattern of the underlying silicon steel, applying a metallic contaminant to the steel at least in the areas of the exposed steel which is free of thermal and plastic stresses, and thereafter annealing the steel having the barrier coating and contaminant thereon at time and temperature in a reducing atmosphere to diffuse sufficient and controlled amounts of the metallic contaminant and an element from the barrier coating into the exposed steel to produce a permanent pore to effect heat resistant domain refinement and reduced core loss.

10 Claims, 4 Drawing Sheets

METHOD OF REFINING MAGNETIC DOMAINS OF BARRIER-COATED ELECTRICAL STEELS USING METALLIC CONTAMINANTS

BACKGROUND OF THE INVENTION

This invention relates to a method for improving core loss by refining magnetic domains. More particularly, the invention relates to a method of processing final texture annealed grain-oriented silicon steels to effect heat resistant domain refinement using a barrier coating on the base-coated steel and using metallic contaminants.

Grain-oriented silicon steel is conventionally used in electrical applications, such as power transformers, distribution transformers, generators, and the like. The steels' ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110)[001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically or 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater than 0.400 watts per pound (WPP) at 1.5 Tesla at 60 Hertz for nominally 9-mil material. High permeability grain-oriented silicon steels are characterized by higher permeabilities which may be the result of compositional changes alone or together with process changes. For example, high permeability silicon steels may contain nitrides, sulfides, and/or borides which contribute to the precipitates and inclusions of the inhibition system which contribute to the properties of the final steel product. Furthermore, such high permeability silicon steels generally undergo cold reduction operations to final gauge wherein a final heavy cold reduction on the order of greater than 80% is made in order to facilitate the grain orientation. While such higher permeability materials are desirable, such materials tend to produce larger magnetic domains than conventional material. Generally, larger domains are deleterious to core loss.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes generally spaced at regular intervals. The scribe lines are substantially transverse to the rolling direction and typically are applied to only one side of the steel.

In fabricating these electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA) is essential to restore usable properties. For such end uses there is a need for a flat, domain-refined silicon steel which will not be subjected to stress relief annealing. In other words, the scribed steel used for this purpose does not have to possess domain refinement which is heat resistant.

However, during the fabrication incident to the production of other transformers such as most distribution transformers in the United States, the steel strip is cut and subjected to various bending and shaping operations which produce much more worked stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

It has been suggested in prior patent art that contaminants or intruders may be effective for refining the magnetic domain wall spacing of grain-oriented silicon steel. U.S. Pat. No. 3,990,923—Takashina et al, dated Nov. 9, 1976, discloses that chemical treatment may be used on primary recrystallized silicon steel to control or inhibit the growth of secondary recrystallization grains. British patent application No. 2,167,324A discloses a method of subdividing magnetic domains of grain-oriented silicon steels to survive an SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and nonmetals are identified as suitable intruder materials.

Japanese Patent Document No. 61-133321A discloses removing surface coatings from final texture annealed magnetic steel sheet, forming permeable material coating on the sheet and heat treating to form material having components or structure different than those of the steel matrix at intervals which provide heat resistant domain refinement.

Japanese Patent Document No. 61-139-679A discloses a process of coating final texture annealed oriented magnetic steel sheet in the form of linear or spot shapes, at intervals with at least one compound selected from the group of phosphoric acid, phosphates, boric acid, borates, sulfates, nitrates, and silicates, and thereafter baking at 300–1200° C., and forming a penetrated body different from that of the steel to refine the magnetic domains.

Japanese Patent Document No. 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

Japanese Patent Document No. 62-51202 discloses a process for improving the core loss of silicon steel by removing the forsterite film formed after final finish annealing, and adhering different metal, such as copper, nickel, antimony by heating.

A copending application, Ser. No. 205,711, filed June 10, 1988, by the Assignee of this invention discloses a method of processing final texture annealed grain-oriented silicon steel to effect heat resistant domain refinement using metallic contaminants. In another copending application, Ser. No. 206,152, filed June 10, 1988, by the common Assignee, there is disclosed a method of refining domain wall spacing of such steel using phosphorus and compounds thereof.

What is needed is a method for refining the magnetic domain wall spacing of grain-oriented silicon steel having a forsterite base coating thereon which is heat resistant. The method should be compatible with conventional processing of regular and high permeability silicon steels and should use the insulative coating, i.e., the forsterite base coating, on the sheet to facilitate the domain refinement. Still further, the method should be useful with numerous techniques including conventional methods for removing the base coating in selected patterns.

SUMMARY OF THE INVENTION

In accordance with the present invention there is provided a method for refining the magnetic domain wall spacing of grain-oriented silicon steel having an insulation base coating, the method which includes removing portions of the base coating to expose a pattern of the underlying silicon steel, and applying a metallic contaminant to the silicon steel, the metallic contaminant selected from the group of copper, tin, nickel, zinc, antimony, combinations and compounds thereof, when the exposed steel is free of thermal and plastic stresses. Thereafter the steel and contaminant thereon are annealed at time and temperature in a protective atmosphere to diffuse sufficient and controlled amounts of decontaminant into the exposed steel to produce a line of permanent porosity to effect heat resistant domain refinement and reduced core loss. The method includes applying to the base-coated steel a barrier coating having a primary constituent selected from the group of phosphorus, silicate, and combinations and compounds thereof for sealing the forsterite prior to applying the metallic contaminant.

DETAILED DESCRIPTION OF THE PREFERRED EMBODIMENTS

Figure 1:
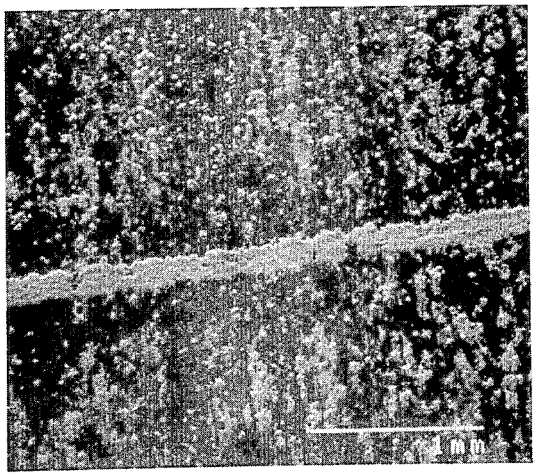
FIG. 1 is a 30× photomicrograph illustrating nodules of antimony on a prior art steel surface.

Broadly, the method of the present invention relates to a method for refinement of the domain structure of grain-oriented silicon steel having relatively large grain sizes by the controlled surface chemical contamination. The method takes final textured annealed silicon steel sheet as the starting material, having the electrically and thermally insulating base coating in place, and then by any of numerous techniques, locally removes the coating to expose the bare metal. No plastic strain or stress of any sort needs to be imposed on the metal and thereafter the exposed bare metal is contaminated by other materials at least on the areas of the exposed metal pattern. Prior to applying the metallic contaminant, the improvement of the present invention is the application of a barrier coating to the base coated steel for sealing the forsterite. The steel is then annealed to diffuse or alloy the contaminant into the iron-silicon steel sheet product. The resulting domain refinement is heat resistant as it survives stress relief annealing.

Particularly, the method of the present invention is an improvement over the method described in the above-cited copending application Ser. No. 205,711, filed June 10, 1988.

The starting material for the chemical striping process of the present invention is final textured annealed grain-oriented silicon steel sheet having an insulative coating in place. Such an insulative coating can be the conventional base coating, also called forsterite or mill glass coating. Preferably, the as-scrubbed final texture annealed grain-oriented silicon steels may be used. Such steels may be cf the regular or conventional grain-oriented silicon steels or of high permeability grain-oriented silicon steels. The particular compositions of such steels are not critical to the present invention and they may be conventional compositions. As used herein the steel melts initially contained the nominal composition as follows:

| | C | N | Mn | S | Si | Cu | B | Fe |
|---|---|---|---|---|---|---|---|---|
| Steel 1 | .030 | <50 ppm | .038 | .017 | 3.15 | .30 | 10 ppm | Bal. |

-continued

| | C | N | Mn | S | Si | Cu | B | Fe |
|---|---|---|---|---|---|---|---|---|
| Steel 2 | .030 | 50 ppm | .07 | .022 | 3.15 | .22 | — | Bal. |
| Steel 3 | .038 | 45 ppm | .078 | .026 | 3.25 | .25 | 5–6 ppm | Bal. |

Steel 1 is a high permeability grain-oriented silicon steel and Steel 2 is a conventional grain-oriented silicon steel and Steel 3 is a modified conventional grain-oriented silicon steel. As used herein, all compositions are by weight percent, unless otherwise specified.

Steels 1, 2, and 3 were produced by casting, hot rolling, normalizing, cold rolling to final gauge with an intermediate annealing when two or more cold rolling stages were used, decarburizing, coating with MgO, and final texture annealing to achieve the desired secondary recrystallization of cube-on-edge orientation. After decarburizing the steel, a refractory oxide base coating containing primarily magnesium oxide was applied before final texture annealing at elevated temperature; such annealing caused a reaction at the steel surface to create a forsterite base coating. Although the steel melts of Steels 1, 2, and 3 initially contained the nominal compositions recited above, after final texture annealing, the C, N and S were reduced to trace levels of less than about 0.001% by weight.

In accordance with the present invention, it is important that portions of the coating be removed to expose a line or stripe pattern of the underlying silicon steel. How the coating is removed is not critical to the present invention except that the underlying steel need not be subjected to any mechanical, thermal, or other stresses and strains as a result of the coating removal operation. In other words, the exposed steel must be free of any thermal and plastic stresses prior to any subsequent steps of applying the metallic contaminant. An advantage of the present invention is that any of various techniques may be used to remove the selected portions of the base coating. For example, conventional mechanical scribing or laser means may be used to develop a controlled pattern of markings on the strip surface. The line or stripe pattern selected for the removed base coating may be conventional patterns used in prior art scribing techniques. Preferably, the pattern may comprise removing the coating in generally parallel lines substantially transverse to the rolling direction of the steel having a line width and spacing as may be conventional. Other patterns may also be useful, depending on whether the grain-oriented silicon steel is of the cube-on-edge, cube-on-face, or other orientation.

In accordance with the present invention, the exposed silicon steel would be plated or coated by selected metals and metal alloys. Preferably, the metals are selected such that they have a diffusion rate slower than iron in silicon steels. The metals and metal alloys suitable for the present invention are referred to as contaminant or diffuser materials. As used herein "contaminant" refers to those certain suitable metals and metal alloys selectively applied to the exposed areas of steel sheet in accordance with this invention. It has been found that various metallic contaminants may be used selected from the group of copper, tin, nickel, zinc, antimony, combinations and compounds thereof. The metallic contaminants may be applied as a coating to the silicon steel using various conventional means such as electroless deposition or electrolytic plating. Because of the insulative nature of the base coating, the metallic contaminant can only be applied in the selected pattern or stripeswhich conform to the pattern of base coating removal. What is important at this point is that the base glass insulation on the silicon steel facilitates selective deposition of the metallic contaminant in the predetermined or preselected pattern.

The silicon steel having the selected portions of base coating removed and having the metallic contaminant applied is thereafter annealed at a time and temperature in a protective atmosphere to diffuse sufficient and controlled amounts of contaminant into the exposed steel to produce permanent pores to effect heat resistant domain refinement and reduced core loss. The annealing has the effect of a diffusion anneal to cause minor alloying of the metallic contaminant with the iron-silicon strip to effect heat resistant domain refinement. The annealing temperature ranges from about 1400° F. (760° C.) or more and may range up to 2100° F. (1150° C.). Preferably, the temperatures range up to 1800° F. (982° C.), and more preferably, from about 1400 to 1700° F. (760 to 927° C.).

It is desirable that the anneal temperature be at least equal to or greater than the temperature that would normally be used for a stress relief anneal in order that the property effects developed would be stable with respect to any subsequent lower temperature treatment such as a stress relief anneal (SRA). In other words, the improvements in core loss would be the result of heat resistant domain refinement. The time for the anneal may range up to 20 hours and preferably may range from 30 minutes to 5 hours at a temperature sufficient to produce the magnetic domain refining. As a practical consideration, the diffusion anneal should be higher than a conventional stress relief anneal of about 1425° F. (774° C.) which may be used by transformer manufacturers following fabrication. Temperatures on the order of up to 1650° F. (899° C.) are sufficient to effect the heat resistant domain refinement without requiring an additional separator coating to prevent adjacent coil laps from thermally welding together during the annealing. Lower temperature anneals may also be successful.

As is known, substantially complete homogeneity is a highly desirable condition for soft magnetic materials. It has been found that proper time and temperature develops and stabilizes the permanent pores and further diffuses the contaminants into the steel to provide a substantially homogeneous steel sheet throughout the steel thickness. Generally, annealing at the higher temperatures facilitates homogeneity. For all annealing in accordance with the present invention, the strip may be annealed either in coil form or as a strand anneal of the continuously moving strip following the application of the metallic contaminant.

Unless otherwise stated, the metallic contaminants used in the examples hereof were selected from the plating solutions described in Table I and were electrolytically plated.

TABLE I

| Plating Metal | Solutions and Conditions |
|---|---|
| Tin | Stannous Sulfate 80 gm/l<br>Sulfuric Acid 52 ml/l<br>Ambient Temperature<br>Stainless or Tin Anodes<br>*.125 A/in$^2$; (1/94 A/dm$^2$); 1 min. |
| Nickel | Nickel Sulfate 328 gm/l<br>Nickel Chloride 60 gm/l<br>Boric Acid 211 gm/l<br>Temperature 130° F.<br>Nickel Anodes<br>*.25 A/in$^2$ (3.88 A/dm$^2$); 15–30 secs. |

TABLE I-continued

| Plating Metal | Solutions and Conditions |
|---|---|
| Copper | Copper Cyanide 24 gm/l<br>Sodium Cyanide 39 gm/l<br>Sodium Hydroxide 39 gm/l<br>Ambient Temperature<br>Copper Anodes<br>*.25 A/in$^2$ (3.88 A/dm$^2$); 30-60 secs. |
| Zinc | Zinc Sulfate 375 gm/l<br>Ammonium Chloride 16 gm/l<br>Temperature 100° F.<br>Stainless Anodes<br>*.25 A/in$^2$ (3.88 A/dm$^2$); 30 secs. |
| Ni-Sn | Stannous Chloride 53 gm/l<br>Nickel Chloride 328 gm/l<br>Ammonium Biflouride 62 gm/l<br>Ammonium Hydroxide (to give pH 2.5)<br>Temperature 150° F.<br>Stainless or Nickel Anodes<br>*0.2 A/in$^2$ (3.1 A/dm$^2$); 1½ mins. |
| Antimony | Antimony Oxide 60 gm/l<br>Hydrofluoric Acid (48%) 120 ml/l<br>Beta-Napthol 1 eyedrop/l<br>Ambient Temperature<br>Stainless Anodes<br>*.07 A/in$^2$ (1.09 A/dm$^2$); 2 mins. |

*Current density pertains to total strip area.

As disclosed in copending application Ser. No. 205,711, filed June 10, 1988, the plating solutions of Table I exhibited improvements in core loss properties which were permanent to provide heat resistant domain refinement. Structures at high magnification tended to be varied and complicated as is not unusual in diffusion-couple metallurgy. The data suggested that the domain refinement was not dependent on development and/or preservation of subtle composition gradients within the chemically striped or treated region. Rather, it appeared that the effect was the Kirkendall porosity phenomenon which is well known in diffusion-couple metallurgy. Although there is no intent to be bound by theory, the Kirkendall related mechanism appears to suggest that contaminants of a different chemical nature can be successfully used as chemical stripe contaminants and that the precise chemical character is not as important as the diffusion rate with respect to the iron base material. A method was developed for providing heat resistant domain refinement compatible with conventional silicon steel processing; was useful with numerous techniques for removing the base coating of final texture annealed material; and was particularly useful on steel which is free from thermal and plastic strains in the region of the selected striping pattern to effect domain refinement. The data of that application demonstrated clearly that plastic strains or deformation play no role in domain refining by chemical striping with metallic contaminants.

Although the metallic contaminants can provide heat resistant domain refinement resulting from domain refinement of unstressed grain-oriented silicon-irons having a good base coating thereon, reproduceability was poor in those cases where the base coating was inadequate. It appears that the naturally-occurring forsterite base coating which results from the final texture annealing sometimes permits spurious plating of the metal contaminant through pores and cracks in the forsterite. Such was evident when nodules of antimony, for example, were found appearing and growing directly out of pores in the forsterite base coating in areas located away from the exposed underlying silicon steel and between the substantially parallel lines as shown in FIG. 1.

It has been found that the use of an additional sealant coating or barrier coating applied to the forsterite before applying the metallic contaminant to the exposed silicon steel stripes results in a striking improvement in consistency and reproduceability to effect heat resistant domain refinement. The main purpose of introducing the barrier coating in the process is to seal the pores and cracks in the forsterite coating. Table II identifies several coatings which are believed to be useful in acting as a barrier coating in accordance with the present invention. The similarity between all of these coatings is that they are all water soluble and cure at relatively low temperatures. Furthermore, these barrier coatings contain phosphorus or silicates, or combinations and compounds thereof as the primary constituent of the coating. Preferably the coating primary constituent is a metal phosphate or metal silicate, and more preferably, the coating should be one that when cured sets up essentially as a magnesium phosphate layer.

TABLE II

| Designation | Barrier Coating and Conditions | Concentration |
|---|---|---|
| SC | Phosphoric Acid (85%) | 202 gm/l |
| | Magnesium Oxide | 22 gm/l |
| | Nalcoag (1050) | 318 ml/l |
| | Chromic Trioxide | 46 gm/l |
| | Water | Balance |
| | Cured: 1000° F.- 1 min. (air) | |
| CS | Sodium Silicate (40-42 Be) | 500 ml/l |
| | Water | Balance |
| | Cured: 800° F. - 1 min. (air) | |
| PS | Phosphoric Acid (85%) | 120 gm/l |
| | Magnesium Oxide | 18 gm/l |
| | Kasil #1 | 22 gm/l |
| | Ammonium Hydroxide (58%) | 21 ml/l |
| | Chromic Trioxide | .34 gm/l |
| | Dupanol (2%) | 1.0 ml/l |
| | Water | Balance |
| | Cured: 800° F. - 1 min. (air) | |
| P | Phosphoric Acid (85%) | 118 gm/l |
| | Magnesium Oxide | 18 gm/l |
| | Ammonium Hydroxide (58%) | 20 ml/l |
| | Chromic Trioxide | .34 gm/l |
| | Dupanol (2%) | 1.0 ml/l |
| | Water | Balance |
| | Cured: 800° F. - 1 min. (air) | |

In order to better understand the present invention, the following examples are presented.

EXAMPLE I

Tests were performed to demonstrate the effect of the barrier coating on enhancing the heat resistant domain refinement process. All of the samples were obtained from various heats of nominally 8-mil gauge silicon steel having the typical composition of Steel 1. Single strips of Steel 1 were mechanically scribed into the as-scribed condition. The scribing effectively removed portions of the base coating in a pattern of substantially parallel lines substantially transverse to the rolling direction of the steel strip. The lines were about 0.25 mm wide and spaced at about 5 mm intervals. Each sample was then coated with barrier coating "P" from Table II after the step of removing the base coating. All of the samples were thereafter electroplated with either zinc or copper from the plating solution listed in Table I. The magnetic properties are Epstein single strip results from strips of 30×3 cm. After electroplating, all of the samples were subjected to a diffusion annealing step at time and temperature set forth in Table III. Percentages indicate change in core loss properties compared to original properties. The magnetic properties were determined in a conventional manner for single strip tests.

TABLE III

| | Original Properties | | | | After 5 hr/1650° F. Diffusion Anneal | | | | | After 10 hr/1650° F. Diffusion Anneal | | | | |
|---|---|---|---|---|---|---|---|---|---|---|---|---|---|---|
| | | Core Loss | | | | Core Loss | | | | | Core Loss | | | |
| | Permeability @ 10 H | @ 1.5 T (wpp) | @ 1.7 T (wpp) | Contaminant | Permeability @ 10 H | @ 1.5 T (wpp) | cf. Change | @ 1.7 T (wpp) | cf. Change | Permeability @ 10 H | @ 1.5 T (wpp) | cf. Change | @ 1.7 T (wpp) | cf. Change |
| G1 | 1935 | .430 | .585 | Zinc | 1940 | .386 | −10% | .523 | −11% | 1940 | .386 | −10% | .530 | −9% |
| G5 | 1922 | .420 | .636 | | 1908 | .406 | −3% | .592 | −7% | 1946 | .413 | −2% | .607 | −5% |
| L9 | 1907 | .412 | .604 | | 1910 | .358 | −13% | .512 | −15% | — | — | — | — | — |
| G3 | 1922 | .499 | .677 | Copper | 1923 | .430 | −14% | .579 | −14% | 1924 | .463 | −7% | .623 | −8% |
| G7 | 1932 | .525 | .700 | | 1934 | .442 | −16% | .598 | −14% | 1938 | .405 | −23% | .545 | −22% |
| F9 | 1952 | .446 | .628 | | 1951 | .417 | −7% | .602 | −4% | 1954 | .396 | −11% | .573 | −9% |
| K13 | 1904 | .478 | .666 | | 1909 | .421 | −12% | .598 | −10% | — | — | — | — | — |
| J2 | 1938 | .473 | .625 | | 1932 | .391 | −17% | .536 | −14% | — | — | — | | — |
| | | Average Improvement (all strips) | | | | | −12% | | −11% | | | −11% | | −10% |

When compared with the control samples which were magnetically tested as received before any treatment, Table III presents data which shows that most of the samples had an attractive improvement in core loss averaging on the order of 10 to 12%. For comparison purposes, samples from the same batches of material were capable of providing 15–20% improvement in core losses by conventional mechanical scribing techniques. A further advantage of the present invention is that such improvement in core loss may be the result of heat resistant domain refinement.

EXAMPLE II

By way of further examples, additional tests were performed to demonstrate the domain refining process on different silicon steels having compositions of Steels 1, 2, and 3 for Epstein test packs. Each sample is prepared in a manner similar to that in the previous Example I, with required modifications to produce the different grain-oriented silicon steels at nominally 7-mil or 8-mil gauge, thereafter processed in accordance with the previous example under the experimental conditions described in Table IV with parallel bands of treated regions about 5 mm apart. The magnetic properties were determined in a conventional manner for Epstein packs.

The data of Table IV show that the domain refining process of the present invention can reduce the core loss in 8-mil gauge material of Steel 1 by up to 11% when compared to initial properties. The best improvement was obtained with the contaminant copper. The core loss in 7-mil material of Steel 2 was reduced by about 5% at 1.5 T and by 5% at 1.7 T. The core loss in 7-mil material of Steel 3 was reduced by about 7% at 1.5 T and by about 4% at 1.7 T.

EXAMPLE III

Further tests were performed to compare the results of domain refining with and without a barrier coating on silicon steel having the composition of Steel 1 for single strip Epsteins. Each sample was prepared in a manner similar to that in Example I. The strips were mechanically scratched to remove the thin base coating in a pattern of substantially parallel lines transverse to the rolling direction. For those samples so marked, the barrier coating "P" was applied after removing the lines of base coating. All the samples where thereafter electroplated with nickel or nickel-tin from the appropriate plating solution of Table I and subjected to a diffusion anneal at time and temperature of 1 to 5 hours at 1600 to 1650° F. in hydrogen. The magnetic properties are Epstein single strip results of nominally 8-mil strip of 30×3 cm. Percentages in parentheses indicate change compared to original properties.

TABLE IV

| | | | Initial Properties | | | 3½ hr. 1650° F. Diffusion Anneal | | | 7 hr. 1650° F. Diffusion Anneal | | |
|---|---|---|---|---|---|---|---|---|---|---|---|
| | | | | Core Loss | | | Core Loss | | | Core Loss | |
| Steel | Gauge (mils) | Contaminant | Permeability @ 10 H | @ 1.5 T (wpp) | @ 1.7 T (wpp) | Permeability @ 10 H | @ 1.5 T (wpp) | @ 1.7 T (wpp) | Permeability @ 10 H | @ 1.5 T (wpp) | @ 1.7 T (wpp) |
| 1 | 8 | Copper | 1920 | .422 | .577 | 1926 | .386 | .520 | 1926 | .389 | .494 |
| 1 | 8 | Ni—Sn | 1916 | .414 | .588 | 1929 | .378 | .516 | 1929 | .369 | .506 |
| 1 | 8 | Zinc | 1919 | .420 | .590 | 1931 | .390 | .539 | 1930 | .378 | .519 |
| 2 | 7 | Copper | 1855 | .441 | .678 | 1853 | .417 | .642 | — | — | — |
| 3 | 7 | Copper | 1868 | .418 | .632 | 1866 | .388 | .604 | — | — | — |

| | Original Properties | | | Chemical Stripe + Diffusion Anneal | | |
|---|---|---|---|---|---|---|
| | | Core Loss | | | | |
| Sample # | Permeability μ10 H | @1.5 T (wpp) | @1.7 T (wpp) | μ10 H | @1.5 T (wpp) | @1.7 T (wpp) |
| | Not Barrier Coated | | | | | |
| Nickel Chemical Stripe | | | | | | |
| P1-10 | 1865 | .473 | .721 | 1885 | .455 (−4) | .644 (−11) |
| P1-11 | 1858 | .496 | .766 | 1849 | .476 (−4) | .733 (−4) |
| P1-12 | 1893 | .494 | .712 | 1879 | .480 (−3) | .650 (−9) |
| Average | 1872 | .488 | .733 | 1871 | .470 (−4%) | .676 (−8%) |
| Nickel-Tin Chemical Stripe | | | | | | |
| J-18 | 1916 | .394 | .534 | 1914 | .380 (−4) | .519 (−3) |
| K-5 | 1893 | .400 | .595 | 1892 | .376 (−6) | .546 (−8) |
| K-14 | 1920 | .414 | .579 | 1921 | .375 (−9) | .520 (−10) |
| L-7 | 1914 | .423 | .613 | 1914 | .396 (−6) | .546 (−11) |
| Average | 1911 | .408 | .580 | 1910 | .383 (−6%) | .533 (−8%) |
| | Barrier Coated | | | | | |
| Nickel Chemical Stripe | | | | | | |
| N-41/5 | 1917 | .470 | .646 | 1867 | .398 (−15) | .555 (−14) |
| N-41/10 | 1918 | .433 | .594 | 1843 | .379 | .525 |

-continued

| Sample # | Original Properties Permeability μ10 H | Core Loss @1.5 T (wpp) | Core Loss @1.7 T (wpp) | Chemical Stripe + Diffusion Anneal μ10 H | @1.5 T (wpp) | @1.7 T (wpp) |
|---|---|---|---|---|---|---|
| Not Barrier Coated | | | | | | |
| N-41/4 | 1899 | .469 | .657 | 1844 | (−12) .427 (−9) | (−12) .620 (−6) |
| Average | 1911 | .457 | .632 | 1851 | .401 (−12%) | .567 (−10%) |
| Nickel-Tin Chemical Stripe | | | | | | |
| G2 | 1940 | .419 | .567 | 1932 | .363 (−13) | .502 (−11) |
| G6 | 1936 | .489 | .665 | 1936 | .428 (−12) | .574 (−14) |
| L4 | 1894 | .443 | .659 | 1896 | .392 (−12) | .561 (−15) |
| L9 | 1907 | .412 | .604 | 1910 | .358 (−13) | .512 (−15) |
| Average | 1919 | .441 | .624 | 1919 | .385 (−13%) | .537 (−14%) |

The data of Table V clearly shows the benefits of the present invention. For comparable samples, the barrier coated samples improved the consistency and reproductibility of the results. All the barrier coated samples had better core loss values than comparable samples which were not so coated. Furthermore, none of the barrier coated samples exhibited any nodules of metallic contaminant on the surface of the sample in areas located away from the exposed pattern line. This finding indicated that the barrier coating had blocked any pores or cracks in the base-glass coating which could have exposed bare metal which would have been plated with the contaminant.

In the course of such experiments, it was unexpectedly found that the barrier coating not only seals the pores and cracks in the base coating of the grain-oriented silicon steel, but it also acts synergistically with the major contaminant in the striped area of the steel during and after the diffusion anneal. Particularly, it is noted that with zinc or the nickel-tin as the major contaminant, phosphorus was evident in the permanent defect produced in the steel.

Figure 2:
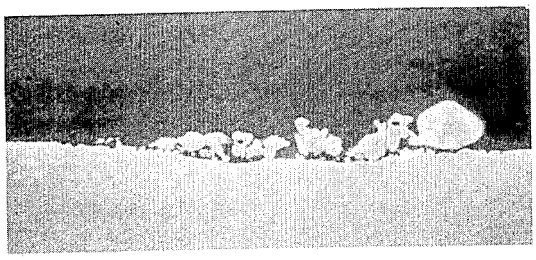
FIGS. 2 and 3 are photomicrographs in cross section on Ni-Sn stripe.
Figure 3:
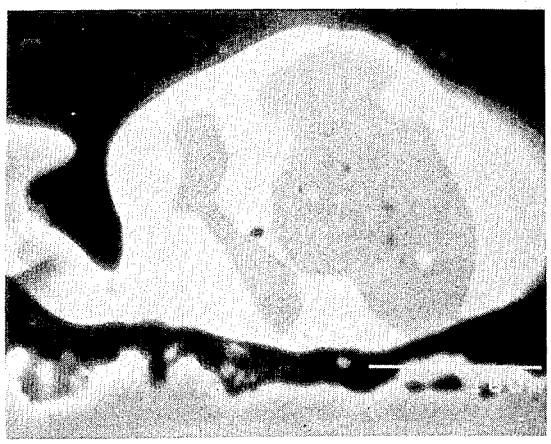
Figure 4:
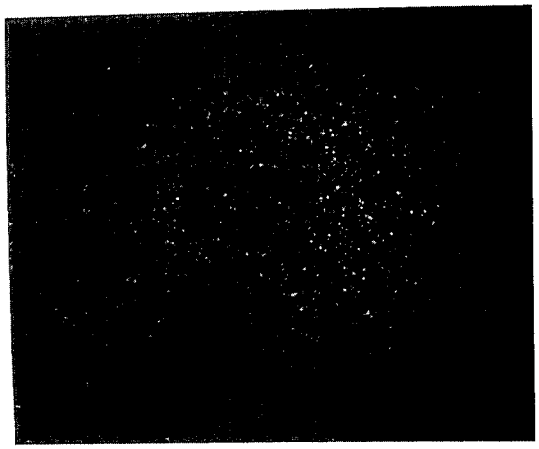
FIGS. 4 through 7 are 3000× photographs of X-ray maps of nickel, tin, phosphorus, and iron in the Ni-Sn strip in the steel.
Figure 5:
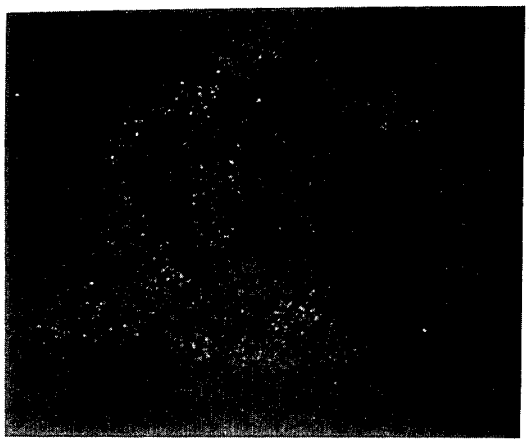
Figure 6:
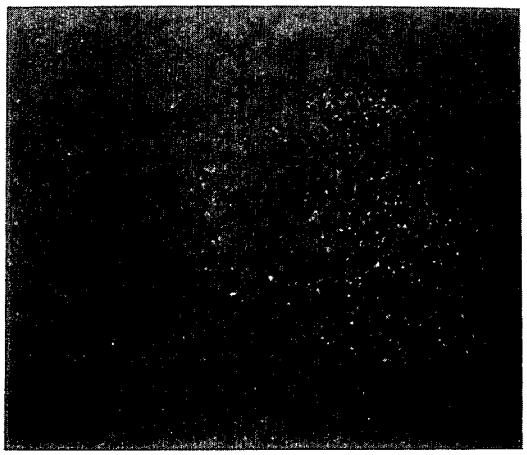
Figure 7:
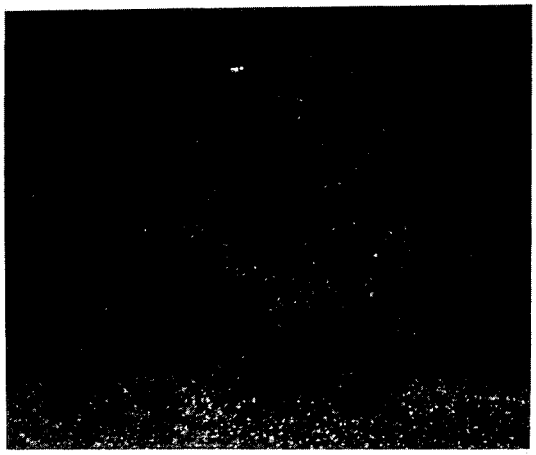

Metallographic examination of various samples in the diffusion annealed zone showed no extensive attack of the substrate steel by the plated deposit which is consistent with the small amount of contaminant deposited and the relatively low diffusion temperatures employed. Structures at high magnification tended to be varied and complicated as is not usual in diffusion-couple metallurgy. Confirmation of interdiffusion between the steel and the contaminant as well as the steel, the contaminant, and phosphorus is shown in FIGS. 2 through 7. In FIG. 2, a cross section at 375× through the Ni-Sn stripe after a two-hour diffusion anneal at 1650° F. shows nodules on the surface of the steel. FIG. 3 shows the same nodule at 3000×. FIGS. 4, 5, 6, and 7 clearly display by Scanning Electron Microscope X-ray mapping the intrusion of nickel, tin, phosphorus, and iron into the diffusion zone.

As was an object of the present invention, a method has been developed for providing heat resistant domain refinement for grain-oriented silicon steels to improve the core loss values. A further advantage of the method of the present invention is the ability to remove portions of the base coating to expose a pattern of the underlying silicon steel such as in lines substantially transverse to the rolling direction by any conventional or unconventional means provided that the steel exposed through the base coating is free from thermal and plastic stresses. The barrier coating enhances the core loss improvements and the reproduceability of such improvements. An advantage of the present invention is that a semifinished sheet product having a barrier coating and metallic contaminant could be produced for subsequent annealing by the customer before or after fabricating into transformer cores.

Although preferred and alternative embodiments have been described, it would be apparent to one skilled in the art that changes can be made therein without departing from the scope of the invention.

What is claimed is:

1. A method for refining the magnetic domain wall spacing of grain-oriented silicon steel sheet having an insulation base coating thereon, the method comprising:

applying to the base coated steel a barrier coating having a primary constituent selected from the group of phosphorus, silicate, and combinations and compounds thereof for sealing the forsterite base coating;

removing portions of the base coating to expose a line pattern of the underlying silicon steel;

applying a metallic contaminant to the steel on the areas of exposed steel, the metallic contaminant selected from the group of copper, tin, nickel, zinc, antimony, combinations and compounds thereof, the exposed steel being free of thermal and plastic stresses and the forsterite base coating having the barrier coating thereon; and thereafter annealing the steel having the barrier coating and contaminant thereon at time and temperature in a reducing atmosphere to diffuse sufficient and controlled amounts of the metallic contaminant and an element from the barrier coating into the exposed steel to produce a line of permanent porosity to effect heat resistant domain refinement and reduced core loss.

2. The method of claim 1 wherein the step of applying the barrier coating is performed followed by the step of removing portions of both the barrier and base coatings and thereafter followed by applying the metallic contaminant.

3. The method of claim 1 wherein the step of removing portions of the base coating is performed before applying the barrier coating to the base coating and thereafter followed by applying the metallic contaminant to the exposed steel.

4. The method of claim 1 wherein the barrier coating is a metal-phosphate-based coating containing at least 25 percent, by weight, of phosphorus in the dried coating.

5. The method of claim 4 wherein the barrier coating is a magnesia-based coating.

6. The method of claim 1 wherein the step of annealing the steel uses a reducing atmosphere of substantially hydrogen.

7. The method of claim 1 wherein the pattern comprises generally parallel lines of exposed steel extending substantially transverse to the rolling direction of the steel.

8. The method of claim 1 wherein the step of annealing includes a temperature range of 1400 to 1700° F.

9. The method of claim 1 wherein prior to the step of annealing the silicon steel having the barrier coating and metallic contaminant thereon, the method includes fabricating the semi-finished sheet product into an article of manufacture and thereafter annealing to effect heat resistant domain refinement and reduced core loss.

10. A method for refining the magnetic domain wall spacing of grain-oriented silicon steel sheet having a forsterite base coating thereon, the method comprising:

applying to the base coated steel a barrier coating having a primary constituent selected from the group of phosphorus, silicate, and combinations and compounds thereof for sealing the forsterite;

thereafter removing portions of both the barrier and base coatings to expose a line pattern of the underlying silicon steel;

then applying a metallic contaminant to the steel on the areas of exposed steel, the metallic contaminant selected from the group of copper, tin, nickel, zinc, antimony, combinations and compounds thereof, the exposed steel being free of thermal and plastic stresses; and thereafter annealing the steel having the barrier coating and contaminant thereon at time and temperature of about 1400° F. or more in a reducing atmosphere of substantially hydrogen to diffuse sufficient and controlled amounts of the metallic contaminant and an element from the barrier coating into the exposed steel to produce a line of permanent porosity to effect heat resistant domain refinement and reduced core loss.

* * * * *